US008763349B2

(12) United States Patent
Prahm et al.

(10) Patent No.: US 8,763,349 B2
(45) Date of Patent: Jul. 1, 2014

(54) METHOD AND DEVICE FOR PRODUCING BUNDLE PACKAGES AND BUNDLE PACKAGE

(75) Inventors: Andreas Prahm, Barβel (DE); Falko Böger, Emden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 314 days.

(21) Appl. No.: 13/128,258

(22) PCT Filed: Nov. 4, 2009

(86) PCT No.: PCT/EP2009/078888

§ 371 (c)(1),
(2), (4) Date: May 9, 2011

(87) PCT Pub. No.: WO2010/060530

PCT Pub. Date: Jun. 3, 2010

(65) Prior Publication Data

US 2012/0279882 A1 Nov. 8, 2012

(30) Foreign Application Priority Data

Nov. 28, 2008 (DE) ..... 10 2008 059 473
Jan. 6, 2009 (DE) ..... 10 2009 004 134

(51) Int. Cl.
*B65B 61/26* (2006.01)

(52) U.S. Cl.
USPC ..... 53/410; 53/443; 53/444; 53/411; 53/128.1; 53/131.2; 53/135.1; 53/136.1; 53/136.4

(58) Field of Classification Search
USPC ..... 53/443, 444, 449, 410, 411, 64, 65, 53/128.1, 131.2, 131.4, 131.5, 135.1, 53/136.1, 136.4
See application file for complete search history.

(56) References Cited

U.S. PATENT DOCUMENTS 2,574,087 A * 11/1951 Burhans ..... 30/2
2,736,448 A * 2/1956 Winn ..... 156/522

(Continued)

FOREIGN PATENT DOCUMENTS

AU 659313 B2 5/1995
CN 1319538 A 10/2001

(Continued)

OTHER PUBLICATIONS

PCT ISR (on parent application)—Dec. 16, 2009.

(Continued)

*Primary Examiner* — Christopher Harmon
(74) *Attorney, Agent, or Firm* — Laurence P. Colton; Smith Risley Tempel Santos LLC

(57) ABSTRACT

A method and device for producing bundle packages, in particular bundle packages (10) for cigarettes (cigarette carton 11), wherein a group of packs (12), in particular cigarette packs, is encased in an outer casing (13) to form the bundle package (10), and wherein the packs (12) respectively exhibit a code (19), in particular a barcode, and the group of packs (12) is encased in the outer casing (13) such that the code (19) of the packs (12) is not concealed by the outer casing (13) and that a means (20, 23) for concealing the code of the packs (12), in particular a pre-cut piece (20), such as an (adhesive) label, and a code (21) for the bundle package (10) are subsequently arranged on the bundle package (10). The bundle package (10) is fed to a coding station (30) for applying the code (21) for the bundle package (10) to the outer casing (13) and/or for affixing the means (20, 23) for concealing the code (19) of the packs (12), the bundle package (10), at least in the region of the coding station (30), being transported by a cyclically driven conveying means (27), and that the code (21) and/or the concealing means (20, 23) are affixed in the coding station (30) during a brief standstill of the conveying means (27).

21 Claims, 6 Drawing Sheets

(56) References Cited

U.S. PATENT DOCUMENTS

| | | | | | |
|---|---|---|---|---|---|
| 4,184,305 | A | * | 1/1980 | Baker et al. | 53/50 |
| RE30,964 | E | * | 6/1982 | Butner et al. | 209/536 |
| 4,762,587 | A | * | 8/1988 | Deal | 156/542 |
| 4,827,114 | A | | 5/1989 | Blachon | |
| 4,969,305 | A | * | 11/1990 | York et al. | 53/136.1 |
| 5,074,400 | A | * | 12/1991 | Focke et al. | 198/415 |
| 5,147,037 | A | * | 9/1992 | Evers et al. | 206/256 |
| 5,168,883 | A | * | 12/1992 | Winn | 131/283 |
| 5,261,533 | A | * | 11/1993 | Adams et al. | 206/261 |
| 5,953,887 | A | | 9/1999 | Lucas | |
| 6,164,040 | A | * | 12/2000 | Bowman, Jr. et al. | 53/411 |
| 6,216,860 | B1 | | 4/2001 | Boriani | |
| 6,669,015 | B2 | | 12/2003 | Draghetti | |
| 6,823,989 | B2 | * | 11/2004 | Wilder et al. | 206/264 |
| 6,843,172 | B2 | * | 1/2005 | Polloni et al. | 101/35 |
| 6,880,313 | B1 | | 4/2005 | Gessford | |
| 7,858,131 | B2 | * | 12/2010 | Billmann et al. | 426/383 |
| 2001/0010332 | A1 | | 8/2001 | Bismarck | |
| 2003/0052020 | A1 | | 3/2003 | Draghetti | |
| 2003/0146068 | A1 | * | 8/2003 | Polloni et al. | 198/461.1 |
| 2004/0045676 | A1 | * | 3/2004 | Chojnacki et al. | 156/350 |
| 2005/0150187 | A1 | | 7/2005 | Raming | |
| 2007/0267303 | A1 | | 11/2007 | Marco | |
| 2011/0078980 | A1 | * | 4/2011 | Pipes | 53/234 |
| 2012/0023868 | A1 | * | 2/2012 | Pipes | 53/399 |

FOREIGN PATENT DOCUMENTS

| | | | |
|---|---|---|---|
| CN | 2491343 | Y | 5/2002 |
| CN | 1615241 | A | 5/2005 |
| EP | 322312 | A1 | 6/1989 |
| EP | 0542449 | A1 | 5/1993 |
| EP | 0909707 | B1 | 4/1999 |

OTHER PUBLICATIONS

German Search Report (on parent application)—Aug. 3, 2009.

Studio Torta, Opposition to European Patent EP-B1-2352676, Jul. 31, 2013.

State intellectual Property Office of the People's Republic of China, Search Report, Aug. 29, 2012.

* cited by examiner

Fig.8
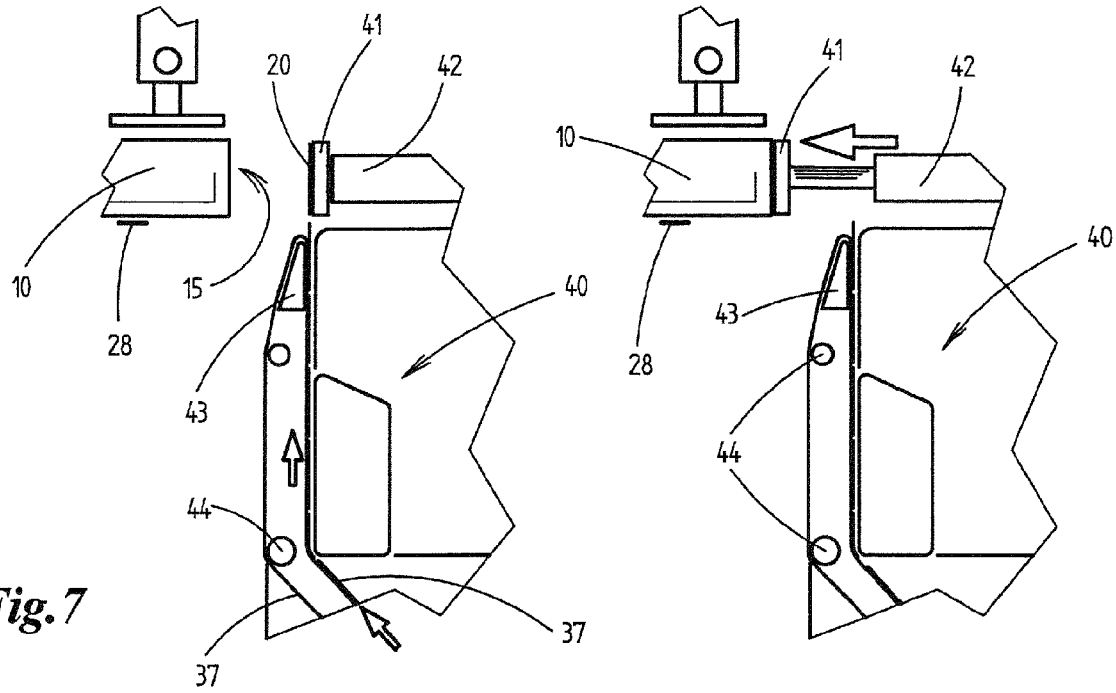
Fig.7
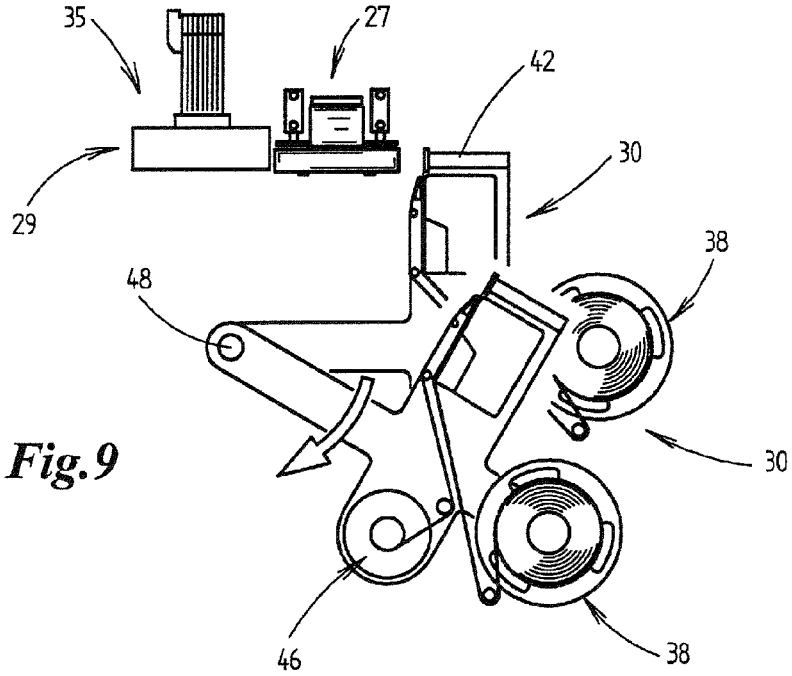
Fig.9

METHOD AND DEVICE FOR PRODUCING BUNDLE PACKAGES AND BUNDLE PACKAGE

BACKGROUND OF THE INVENTION

1. Technical Field

The invention relates to a method for producing bundle packages, in particular bundle packages for cigarettes (cigarette carton), wherein a group of packs, in particular cigarette packs, is encased in an outer casing to form the bundle package, and wherein the packs respectively exhibit a code, in particular a barcode, and the group of packs is encased in the outer casing such that the code of the packs is not concealed by the outer casing and that a means for concealing the code of the packs, in particular a pre-cut piece or an (adhesive) label, and a code for the bundle package are then arranged on the bundle package. The invention further relates to a device for implementing the method. Finally, the invention relates to a bundle package produced, in particular, according to the method.

2. Prior Art

Bundle packages have long been known, particularly in the field of the cigarette industry. Here the packs or cigarette packs which form the content of the bundle package or cigarette carton are generally arranged side by side and, preferably, in a plurality of rows one behind the other. A preferred formation is an arrangement of packs in two rows of five packs each. The pack content is generally enveloped in an outer casing made of a packaging material such as paper or board, which, if necessary, can be surrounded by an additional protective wrapping, for example of polypropylene, polyethylene, cellophane or the like, in order to seal the bundle package in an aroma-tight manner.

Furthermore, it is customary to provide each of the packs with a code, in particular a machine-readable code such as a barcode. Apart from information relating to the manufacture or about the manufacturer, the code can also provide information for the actual sale to the end customer, for example information for retrieving the sale price from a product database or the like.

In addition, bundle packages are known in which the outer casing is configured such that the packs are partially visible. This category of bundle packages also includes the so-called "Naked Wrap", in which the outer casing is formed merely by a transparent protective wrapping of polypropylene. This results in the packs or their code being visible or readable through the outer casing. In the sale of these and similar bundle packages, the problem exists, however, that the code of the pack instead of the code of the bundle package may accidentally be read in, which can result in a false computation of the sale price of the bundle package.

One solution to this problem consists in providing the bundle package with a pre-cut piece, for example a label, for covering the code of the pack. This label can also exhibit the code for the bundle package.

BRIEF SUMMARY OF THE INVENTION

Starting from the above, the object of the invention is to propose measures which lead to a favorable production of bundle packages of this specific type.

A method according to the invention is a method for producing bundle packages for cigarettes, wherein a group of cigarette packs is encased in an outer casing to form the bundle package, and wherein the packs respectively exhibit a code, and the group of packs is encased in the outer casing such that the code of the packs is not concealed by the outer casing and that a means for concealing the code of the packs and a code for the bundle package are then arranged on the bundle package, comprising feeding the bundle package to a coding station for applying the code for the bundle package to the outer casing and/or for affixing the means for concealing the code of the packs, wherein the bundle package, at least in the region of the coding station, is transported by a cyclically driven conveying means, and briefly pausing the conveying means, wherein the code and/or the concealing means are affixed in the coding station during the brief pause of the conveying means. According to this, it is provided that the bundle package is fed to a coding station for applying the code for the bundle package to the outer casing and/or for affixing the means for concealing the code of the packs, the bundle package, at least in the region of the coding station, being transported by a cyclically driven conveying means, and that the code and/or the concealing means are affixed in the coding station during a brief pause of the conveying means.

Preferred embodiments and refinements of the method according to the invention emerge from the subclaims and the rest of the description.

Preferably, the coded bundle package is subsequently fed to a checking station, in particular for checking the code and/or the concealment of the code of the packs, wherein defective bundle packages are separated out in the region of an ejection station arranged after the checking station.

One particularity can consist in the fact that the bundle package, at least in the region of the coding station and/or of the checking station, is transported with its longitudinal extent substantially transversely to the direction of transport of the conveying means, and that the code of the bundle package is affixed in the region of the code of the packs by a coding station arranged beside the conveying means, preferably in the region of transversely directed end faces of the bundle package. This arrangement allows a simple application of the code and/or of labels in the region of the code of the packs.

Preferably, the bundle package is firstly transported with its longitudinal extent substantially parallel to the direction of transport of the conveying means and, prior to reaching the coding station, is turned in a turning station through about 90°, so that the bundle package is transported with its longitudinal extent substantially transversely to the direction of transport of the conveying means, wherein the bundle package, after the coding station and/or the checking station, is turned in a further turning station once more through about 90°, so that it is transported with its longitudinal extent substantially again parallel to the direction of transport of the conveying means. A simple integration into existing devices for the production and packaging of bundle packages is in this way possible.

In a particularly preferred embodiment of the method, in the coding station the code of the packs is overprinted and the code of the bundle package is affixed to, in particular imprinted on, the outer casing. The application of a pre-cut piece for concealing the code of the packs can hence be dispensed with.

With respect to the application of separate pre-cut pieces for concealing the code of the packs, it is conceivable that a continuous material strip is provided at intervals with a code for respectively a bundle package and is subsequently separated into pre-cut pieces by cutting of the material strip between the codes, and that the pre-cut pieces are provided with glue and are fastened in the coding station to respectively an outer casing of a bundle package.

It can be advantageous to arrange the coding station in the path of conveyance between a device for producing the bundle packages (carton packer) and a device for grouping and/or cartoning the coded bundle packages (cartoning machine) in order to ensure integration into existing packaging machines.

A device for achieving the object stated in the introduction is a device for producing bundle packages for cigarettes, wherein a group of cigarette packs respectively exhibits a code, and for the formation of the bundle package are encased in an at least partially transparent outer casing, so that the code of the packs is visible or readable through the outer casing, and wherein on the outer casing are arranged means for covering the code of the packs and a code of the bundle package, comprising a conveyor line formed by a conveying means and a coding station, wherein the coding station is arranged along the conveyor line formed by a conveying means for the bundle packages, the coding station being for affixing the means for concealing the code of the packs and/or for affixing the code to the bundle package in the region of the code of the packs, wherein the conveying means is cyclically driven to allow the application of the concealing means and/or code means to the bundle package during a stationary phase of the conveying means. Along a conveyor line formed by a conveying means for the bundle packages there is accordingly arranged a coding station for affixing the means for concealing the code of the packs and/or for affixing the code to the bundle package in the region of the code of the packs, wherein the conveying means is cyclically driven to allow the application of the concealing or code means to the bundle package during a stationary phase of the conveying means.

Downstream of the coding station, in the region of the conveyor line, there is preferably arranged a checking station for checking, in particular, the code. Downstream of the checking station can be arranged an ejection station for separating out bundle packages having, in particular, an incorrect code.

The bundle package, at least in the region of the coding station and/or of the checking station, can be arranged on the conveying means with its longitudinal extent pointing substantially transversely to the direction of conveyance, with end faces of the bundle package facing a coding station arranged next to the conveyor line.

In a preferred embodiment of the invention, it is provided that pre-cut pieces for concealing the code of the packs can be fed from a reel to the coding station, wherein on the reel is wound a continuous material strip as the backing material carrying, as the pre-cut pieces, labels arranged one behind the other at a distance apart, and wherein the material strip is transportable in a plane running parallel to the end face of the bundle packages, and wherein the labels preferably in this vertical conveyor section are printed in a printing station, and wherein the labels are detachable from the backing strip by diversion of the material strip, and wherein in the region of the diversion is arranged a slide bar for receiving a label detached from the backing strip, and wherein the slide bar is movable in a substantially horizontal plane toward a facing end face of the bundle package in order to affix the label to the outer casing of the bundle package.

Alternatively, it can be provided that to the coding station there is assigned a reel bearing a continuous material strip of packaging material for the formation of pre-cut pieces for concealing the code of the packs, wherein the material strip can be drawn off from the reel and can be fed to a printing station for the application of a code and/or of an additional print on the continuous material strip, and that the printed material strip can be fed to a gluing station for applying a coating of glue to the material strip, and that the glued material strip can be fed to a cutting station for separating pre-cut pieces from the material strip, and that the separated pre-cut pieces are movable by means of a slide bar onto an end face of the bundle package for the application of the printed, glue-coated and separated pre-cut piece to the outer casing of the bundle package.

A further particularity can consist in the fact that two coding stations are arranged consecutively along the conveyor line, wherein always just one coding station is in operation for the uninterrupted operation of the coding station during the supply of new material to one of the two coding stations or during a change of material.

A bundle package according to the invention is a bundle package comprising a group of cigarette packs, in particular cigarette packs, which are encased in an outer casing to form the bundle package, in particular the bundle package being a cigarette carton for cigarettes, wherein the outer casing consists of an at least partially transparent material, so that a code, in particular barcodes, of the packs is visible or readable through the outer casing, wherein the bundle package, in the region of the code of the packs has means for concealing the code of the packs, and wherein the bundle package exhibits a code for the bundle package, wherein the code of the packs is concealed by a print on the outer casing, and wherein the outer casing exhibits a preferably additional print for the code of the bundle package. One particularity consists in the fact that the code of the packs is concealed by a print on the outer casing, and that the outer casing exhibits a preferably additional print for the code of the bundle package. The application of a pre-cut piece for concealing the code of the packs can thereby be dispensed with.

BRIEF DESCRIPTION OF THE DRAWINGS

The invention is explained below on the basis of preferred illustrative embodiments in accordance with the drawing, in which:

FIG. 9 shows a detail of FIG. 6 on a reduced scale during a change of material.

DETAILED DESCRIPTION OF PREFERRED EMBODIMENTS

Figures 1, 2:
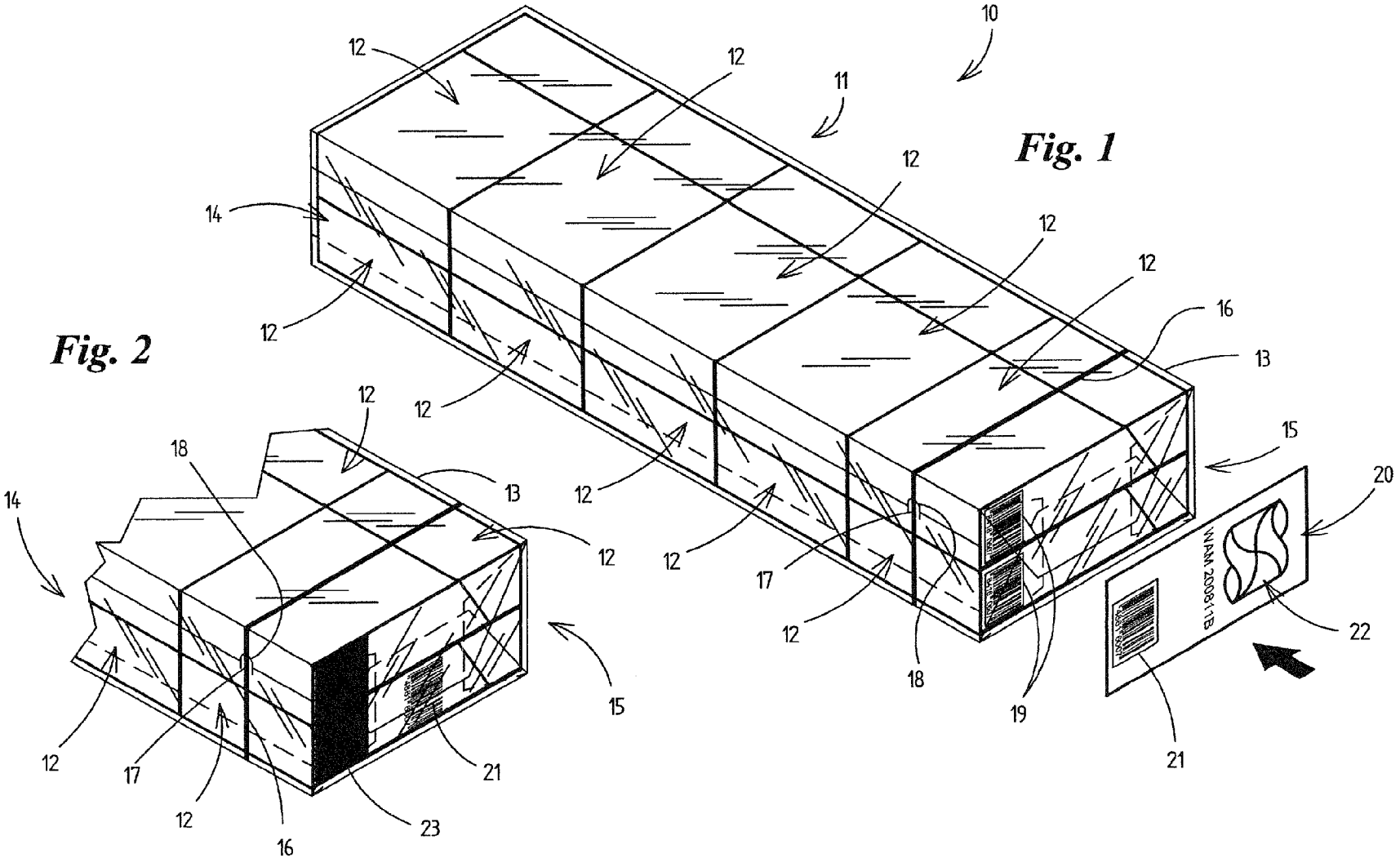
FIG. 1 shows a bundle package in the form of a cigarette carton in schematic three-dimensional representation.
FIG. 2 shows an end face of the bundle package according to FIG. 1 according to an alternative illustrative embodiment.

The invention is explained below on the basis of an example from the cigarette industry. A bundle package 10 in the form of a cigarette carton 11 is shown. The pack content of the cigarette carton 11 consists of cigarette packs 12 which are arranged as a group in two rows of respectively five cigarette packs 12. Within the rows, the cigarette packs 12 lie with mutually facing narrow sides side by side. The two rows are arranged one behind the other, so that an upper or first row of cigarette packs 12 rests or bears with a large-area rear side on or against a large-area front side of a lower or rear row.

The pack content is encased in an outer casing 13, which in the present case is made of a polypropylene film and is transparent, i.e. allows a view of the cigarette packs 12. The outer casing 13 is wound in a tube-like manner around the group of cigarette packs 12 and is sealed in an overlap region 14. In the region of the end faces 15 of the bundle package 10, folding tabs of the outer casing 13 are placed one over the other in the manner of an envelope and joined together, in particular by sealing. For the opening of the outer casing 13 a tear thread 16 is provided, which tear thread, running eccentrically and transversely to the longitudinal direction of the bundle package 10, extends around the latter. One end 17 of the tear thread 16 is delimited by a U-shaped punch cut 18 to enable the end 17 to be more easily gripped for opening of the outer casing 13.

The cigarette packs 12 exhibit in the region of their narrow side a code 19. In the present case, the code 19 is constituted by a barcode, i.e. a machine-readable identification. Due to the fact that the outer casing 13 consists of a transparent material, the code 19 of the cigarette packs 12 in the region of the end face 15 of the bundle package 10 is visible from the outside.

To ensure that the code 19 is not accidentally scanned by a till scanner during the sale of the bundle package 10, according to FIG. 1 it is provided that, in the region of the end face 15 of the bundle package 10, a separate pre-cut piece 20 in the form of an (adhesive) label is affixed. On the one hand, the pre-cut piece 20, due to its positioning and size, covers the code 19 of the two cigarette packs 12 in the region of the end face 15. In addition, the pre-cut piece 20 bears a code 21 for the bundle package 10. Following the application of the pre-cut piece 20 to the outer casing 13 of the bundle package 10, the codes 19 of the cigarette packs 12 can no longer be read or scanned, but only the code 21 of the bundle package 10.

A further particularity consists in the fact that the pre-cut piece 20 exhibits an additional, in particular individual print 22. This print 22 can have creative and/or information-containing elements.

According to an alternative illustrative embodiment shown in FIG. 2, the code 19 of the cigarette packs 12 is concealed not by a separate pre-cut piece 20, but by a print 23 on the outer casing 13. In the present case, the print 23 extends only in the region of the code 19 of the cigarette packs 12. In addition, the code 21 for the bundle package 10 is printed onto the outer casing 13, though laterally offset relative to the print 23. It is also conceivable for the code 21 to be part of the print 23.

A further illustrative embodiment (not shown in the figures) can be configured such that the group of cigarette packs 12 is partially encased in a pre-cut piece made of packaging material, namely such that the end faces 15 are not concealed by the pre-cut piece. As in the illustrative embodiment according to FIG. 1, the group of cigarette packs 12 which is enwrapped with the pre-cut piece is then encased in an outer casing 13. In this case, too, the codes 19 of the cigarette packs 12 are visible through the outer casing 13 and can be concealed either with a pre-cut piece 20 or with a print 23.

Figure 3:
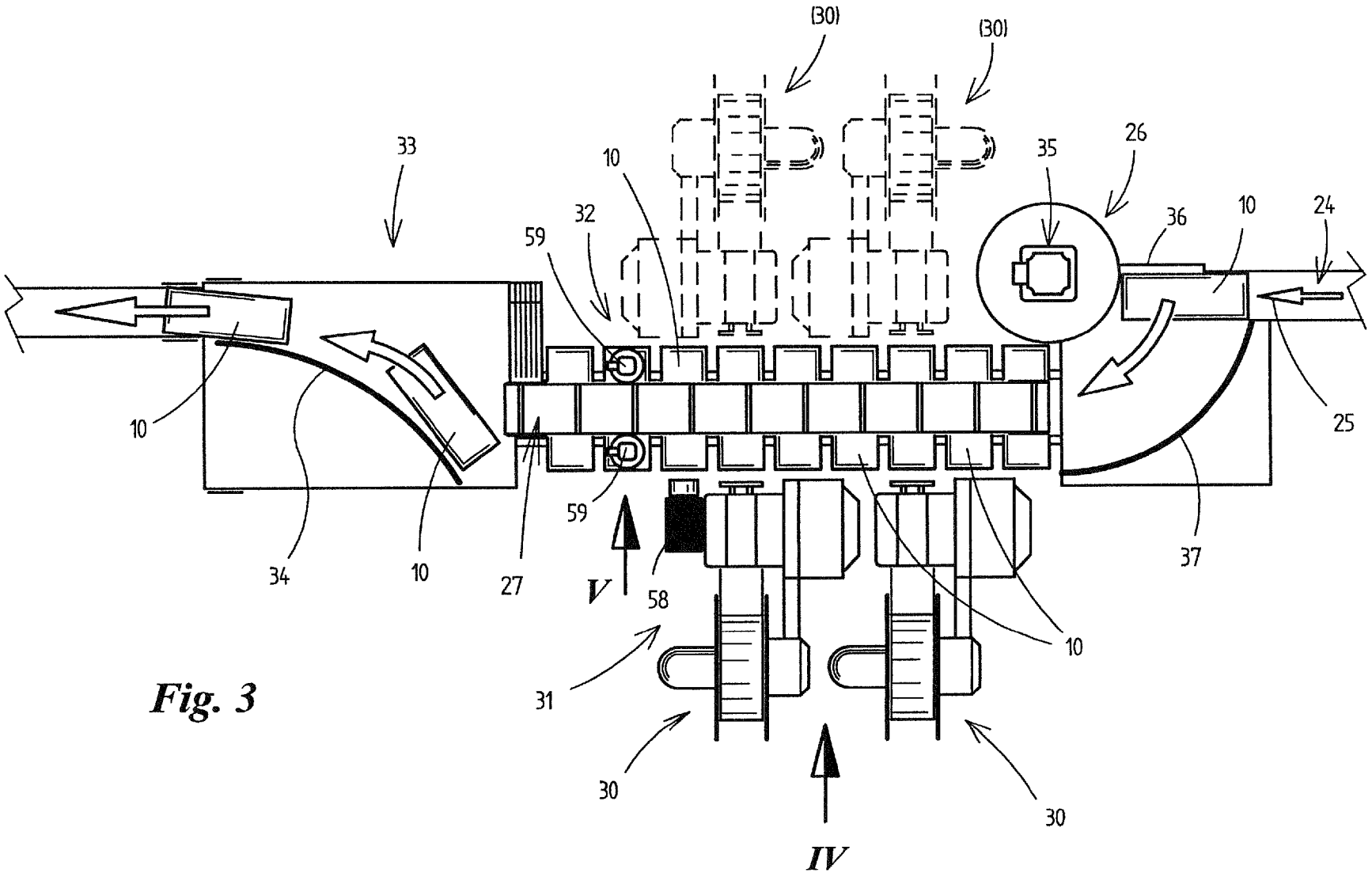
FIG. 3 shows a device for affixing labels to bundle packages in a schematic top view.
Figure 4:
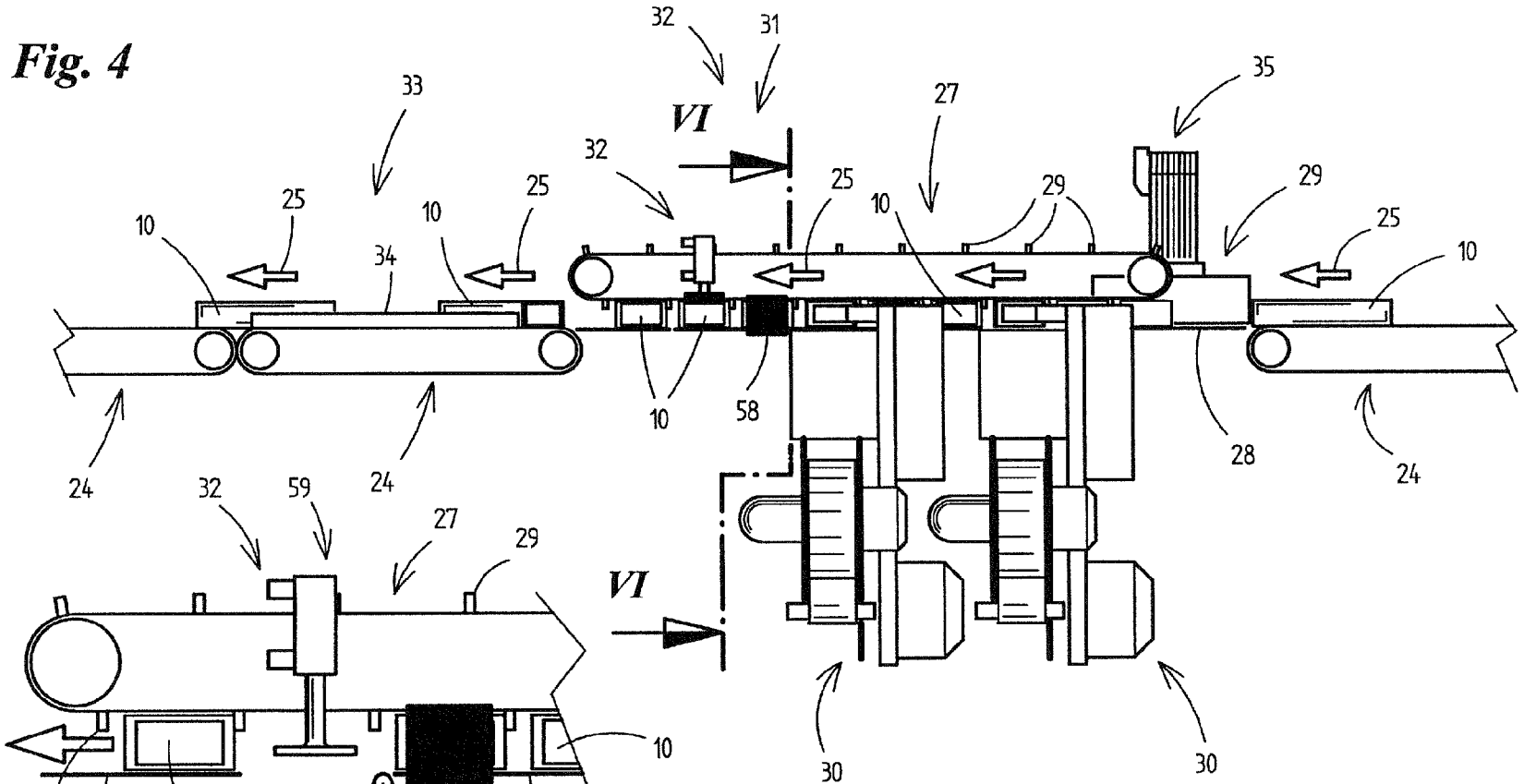
FIG. 4 shows the device according to FIG. 3 in a side view.
Figure 5:
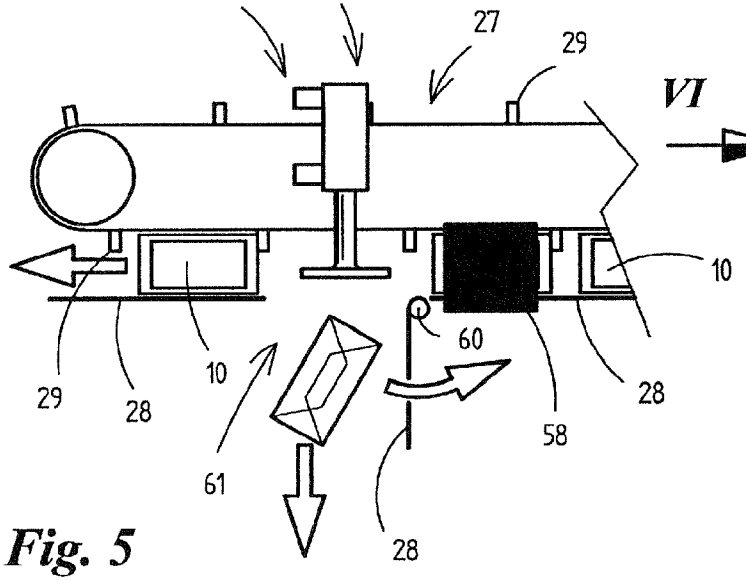
FIG. 5 shows a side view of the device according to FIG. 3 on an enlarged scale 5 on an enlarged scale.

FIG. 3 shows a part of a device for producing and handling bundle packages 10. The structure is roughly as follows: the bundle packages 10, emanating from a carton packer (not shown), are transported on a conveying means, in particular an endless conveyor belt 24, in a direction of transport according to the arrow 25. On the conveyor belt 24, the bundle packages 10 are here transported such that they lies flat on a large-area side and with their longitudinal extent pointing in the direction of conveyance according to the arrow 25.

The bundle packages 10 then enter into the region of a first turning station 26, in which the relative position of the bundle packages 10 is turned through 90°, so that the bundle packages 10 point with their longitudinal extent transversely to the direction of conveyance.

Following on from the turning station 26, the bundle packages 10 enter into the region of a further conveying means 27 for transport of the transversely orientated bundle packages 10. In the region of the conveying means 27, the bundle packages 10 rest on the bottom side on a plane of conveyance 28 and are transported on the top side by mutually spaced drivers 29 of a conveyor belt configured as a circulating endless conveyor. The drivers 29 here capture the bundle packages 10 by an upper edge situated to the rear in the direction of transport.

The conveying means 27 is cyclically driven for the intermittent advancement of the bundle packages 10 along the plane of conveyance 28. In this way, the mutually spaced, transported bundle packages 10 make their way step by step through this region of the device.

Consecutively in the transport direction according to the arrow 25, a plurality of stations for treating the bundle package 10 are arranged, following one behind the other, in the region of the conveying means 27. These are constituted firstly by two coding stations 30, as well as a checking station 31 and an ejection station 32.

In the coding stations 30, the pre-cut piece 20 or the print 23 and code 21 is firstly affixed to the bundle packages 10, according to FIGS. 1 and 2. In the region of the checking station 31, the treated bundle package 10 is then checked for correct configuration and, where necessary, for bundle packages 10 which have been found to be defective, discharged from the conveying means 27 in the region of the ejection station 32. These steps are described in greater detail below.

In the further transport path of the bundle packages 10, a further turning station 33 is provided in order to turn the bundle packages 10 back into the original relative position on the conveyor belt 24. In the region of the turning station 33 and following on from this, the bundle packages 10 are transported back on conveyor belts 24 and are hereupon turned during transport by contact against a curved baffle plate 34. In the region of the second conveyor belt 24, the treated bundle packages 10 are fed to a machine for packing the bundle packages 10 into boxes, i.e. a cartoning machine (not shown). In the region of the first turning station 26, the bundle package 10 is seized by means of a swivel arm 36 driven rotatingly in a horizontal plane by a motor 35 and, in contact with a further curved baffle plate 37, is swiveled into the transversely directed position.

One particularity exists in respect of measures to integrate the coding station 30 into existing plants. Thus the bundle packages 10 are transported before the first turning station 26 and the second turning station 33 on the two conveyor belts 24 in the longitudinal direction of the bundle packages 10. The conveyor belts 24 run in parallel and along an imaginary straight line. Laterally offset thereto, but parallel to the conveyor belts 24, there is arranged the conveying means 27, in the region of which the coding stations 30 are positioned. As a result of this arrangement, it is possible to split up a continuous conveyor belt 24 and, parallelly and laterally offset thereto, to integrate the conveying means 27, which is connected via the turning stations 26, 33 to the two conveyor belts 24. It is also conceivable, however, for the conveying means 27 to be integrated into the course of the conveyor belts 24, i.e. with no lateral offset.

Figure 6:
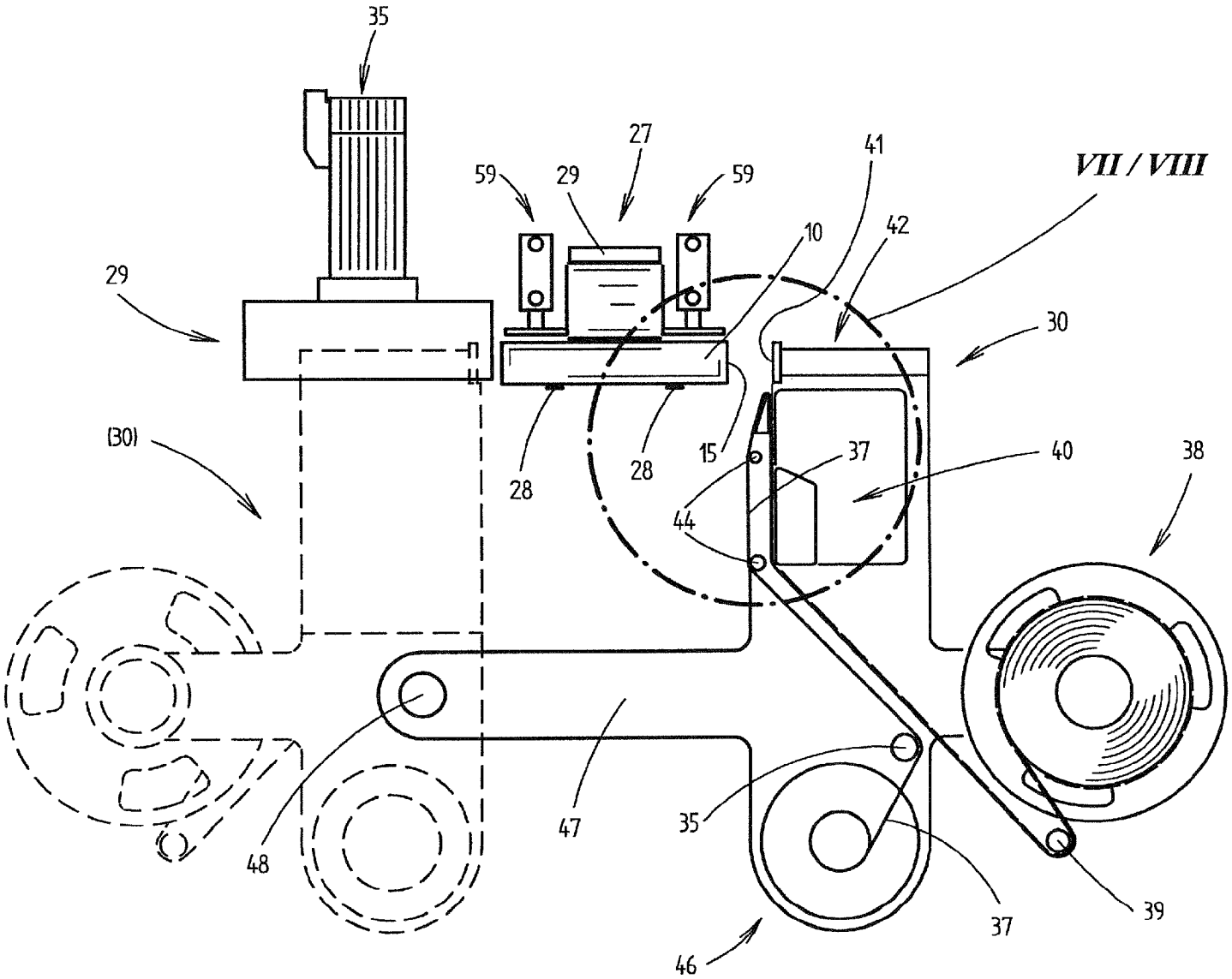
FIG. 6 shows a vertical section through the device along the sectional line VI-VI in FIG. 4, FIG. 7 and FIG. 8 show a detail of FIG. 6 on an enlarged scale during different phases of the application of a label.

It should further be mentioned that the coding stations 30 can optionally also be arranged on the opposite side of the conveying means 27, depending on the position or arrangement of the cigarette packs 12 within the bundle package 10, i.e. depending on the side on which the codes 19 of the cigarette packs 12 are visible in the region of the end face 15 of the bundle package 10. The use of two coding stations 30 is not absolutely necessary, i.e. just one coding station 30 may also be provided. In order to avoid a stoppage of the device during a change of material or the supply of other pre-cut pieces 20, two coding stations 30, which are used alternately, are preferred however. Preferably, only one of the two coding stations 30 in each case is thus in operation, the respectively other coding station 30 taking over as soon as the other coding station 30 receives new and/or different material for the pre-cut pieces 20 or has to be serviced. In FIGS. 3 and 6, the coding stations 30 on the other side of the conveying means 27 are indicated with dashed lines.

The application of a pre-cut piece 10 in the form of a self-adhesive label, according to FIG. 1, is explained below. FIG. 6 shows, in this regard, a schematic representation of the device in the form of a vertical section transversely to the direction of transport. It is here evident, on the one hand, that the plane of conveyance 28 is formed by two web-like members, which extend in the longitudinal direction of the conveying means 27 at a distance apart and on which the bundle packages 10 on the bottom side rest. The pre-cut pieces 20 are located on a backing material 37, which, wound up on a reel 38, is held in readiness. The backing material 37 is wound off from the reel 38 and is firstly guided downward to a first deflection roller 39. From there, the backing material 37 runs obliquely upward into the region of a printing station 40. In the region of the printing station 40, the backing material 37 is transported in a vertical plane and at the same time printed upon. On the one hand, the code 21 in the form of a barcode, as well as the additional print 22, can be imprinted. Instead of the application of the additional print 22 in the printing station 40, said print can also already have been applied during manufacture of the reel 38. The same applies in principle also to the code 21 in the form of the barcode. However, both the code 21 and the print 22 are preferably affixed in the region of the printing station 40.

In the region of an upper end of the printing station 40, the pre-cut pieces 20 or labels are detached from the backing material 37 and passed on to a slide bar 41, which affixes the pre-cut pieces 20 to the end face 15 of the bundle package 10. To this end, the slide bar 41 can be moved to and fro in a horizontal plane, for example by means of a pneumatic cylinder 42. The slide bar 41 therefore operates in the same plane in which the bundle packages 10 too are transported. The pre-cut pieces 20 are held on the front side of the slide bar 41 by means of underpressure or vacuum, so that the sticky side of the label points toward the end face 15 of the bundle package 10. By extension of the pneumatic cylinder 42, the label is pressed against the end face 15 and affixed there. The detachment of the pre-cut pieces 20 from the backing material 37 can be realized by a wide-angled diversion of the backing material 37, so that the labels are detached automatically. In the present case, the backing material 37, in the region of the bottom side of the slide bar 41, is diverted at a deflection rail 43 by approximately 180° and is then conveyed via a deflection roller 44 downward in a vertical plane. After a further deflection roller 44 is reached, the backing material 37 is conveyed obliquely downward and is fed via a further deflection roller 45 to a wind-up roller 46, on which the empty backing material 37 is rolled up.

The coding station 30 is mounted pivotably on a machine frame (not shown in detail). To this end, a support 47 for the coding station 30 is arranged pivotably on an axis 48 and serves to receive the elements of the coding station 30, i.e. essentially the reel 38, the wind-up roller 46, the printing station 40, the slide bar 41 and the guide for the backing material 37. For the exchange of the reel 38, the coding stations 30, as shown in FIG. 9, can be swiveled about the axis 48.

Figure 10:
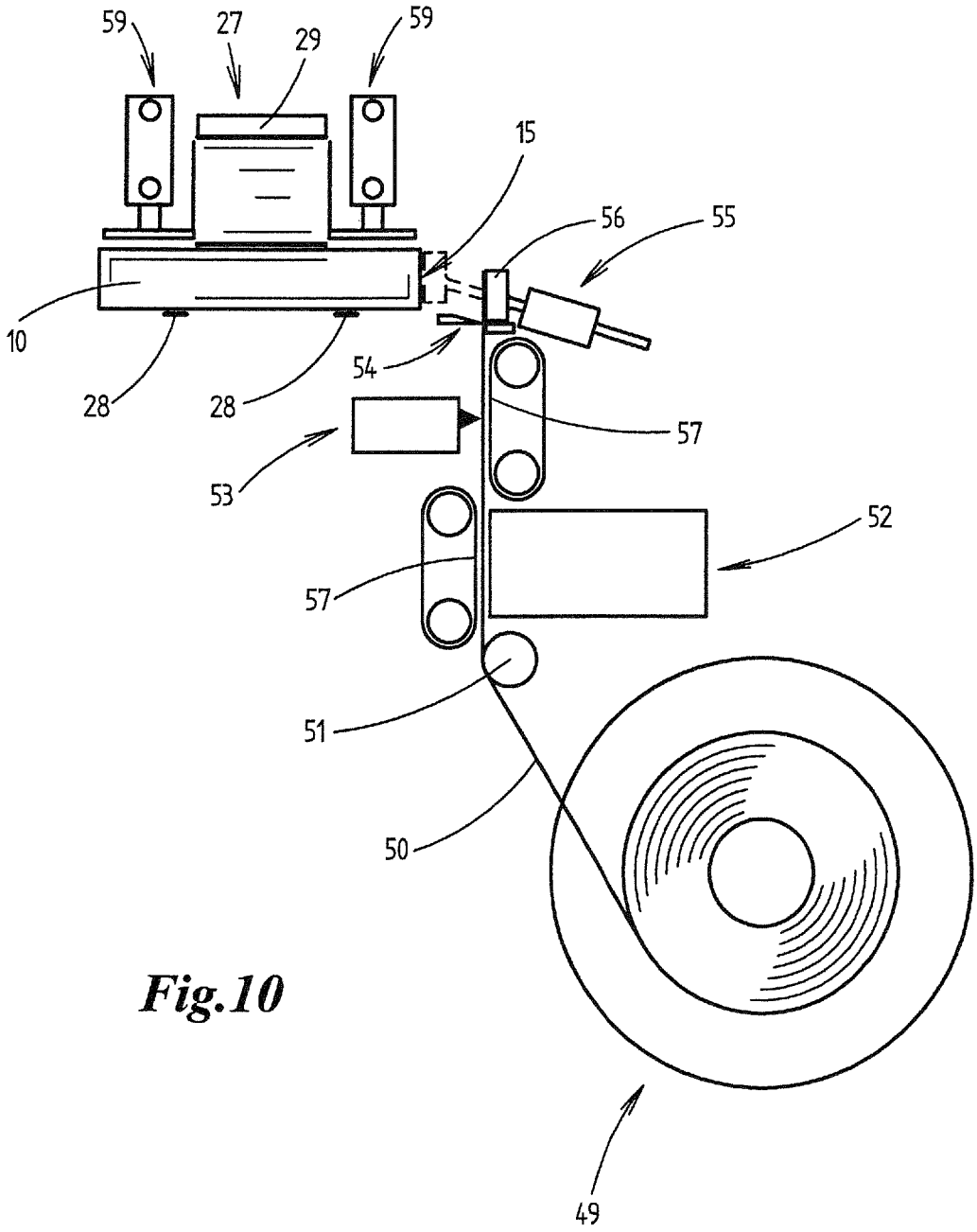
FIG. 10 shows an alternative solution for the application of labels in a representation analogous to FIG. 6.

FIG. 10 shows an alternative solution for concealing the codes 19 of the cigarette packs 12. Here, an endless material strip of a packaging material 50 is drawn off from a reel 49 and fed via a deflection roller 51 to a printing station 52. After this, the packaging material 50 makes its way into the region of a gluing station 53, in which the packaging material 50 is glued. This is followed by a cutting station 54 for separating pre-cut pieces 20 from the continuous material web of the packaging material 50, and, comparably to the illustrative embodiment according to FIGS. 6 to 9, by a pneumatic cylinder 55 for actuating a slide bar 56, which slide bar presses the separated-off pre-cut pieces 20 against the end face 15 of the bundle package 10. Opposite the printing station 52 and the gluing station 53, the packaging material 50 is respectively driven and/or supported by a conveyor belt 57.

The packaging material 50 can be constituted by pre-printed material which is already provided at intervals, for example, with the code 21, in which case only the additional print 22 is affixed with the aid of the printing station 52. Alternatively, the packaging material 50 can also be constituted by material which exhibits neither the code 21 nor the print 22, so that this is applied in the region of the printing station 52. For the gluing of the material web, permanent adhesive is preferably applied, so that the separated pre-cut pieces 20 can be glued against the end face 15 of the bundle package 10.

For the checking of the bundle packages 10 there is provided in the checking station 31 a monitoring member, in particular a monitoring camera 58, which is aligned to the end face 15 of the bundle package 10. In this way, with the aid of the monitoring camera 58, an image of the end face 15 can be recorded and compared with a reference image. This can be realized in a control device (not shown). Insofar as the code 19 of the cigarette packs 12 is not fully concealed or the code 21 of the bundle packages 10 is defective, the corresponding bundle package 10 can be separated out in the ejection station 32. Of course, further features of the bundle package 10 can also be checked in the checking station 31.

In the ejection station 32, on both sides of the conveying means 27 there are arranged two slide bars 59 for separating out a defective bundle package 10. The slide bars 59 act in the upright or vertical direction and serve to eject a defective bundle package 10 downward. To this end, a portion of the plane of conveyance 28 can be pivoted about a hinge joint 60, so that an opening 61 is formed in the plane of conveyance 28, through which opening the bundle package 10 is expelled by the slide bars 59. Preferably, the slide bars 59 can be actuated by pneumatic cylinders.

In place of bundle packages 10 for cigarette packs 12, other varieties of pack contents can also be treated correspondingly. Nor does the bundle package 10 have to consist of two rows of cigarette packs 12, but it can instead have a greater or lesser number of rows. The number of cigarette packs 12 within a row can also vary, without this departing from the invention.

The arrangement of the coding stations 30 in relation to the conveying means 27 can be chosen according to the arrangement of the code 19 on the cigarette packs 12 or the alignment of the cigarette packs 12 within the bundle package 10. An adaptation of the device to cigarette packs 12 in which the code 19 is not disposed in the region of narrow sides of the cigarette packs 12 is also conceivable.

It is further conceivable that the pre-cut piece 20 or the print 22, 23 does not have to be affixed to the outer casing 13 simultaneously or in the same station, but rather this can be done in two or more consecutive steps. In this case, the coding station 30 comprises, within the meaning of the invention, all members which are necessary to perform these work steps.

The codes 19, 21 are preferably constituted by barcodes. However, other codes too can be used, in particular other machine-readable identifications.

REFERENCE SYMBOL LIST

10 bundle package
11 cigarette carton
12 cigarette pack
13 outer casing
14 overlap region
15 end face
16 tear thread
17 end
18 punch cut
19 code (cigarette pack)
20 pre-cut piece
21 code (bundle package)
22 print (pre-cut piece)
23 print (outer casing)
24 conveyor belt
25 arrow
26 turning station
27 conveying means
28 plane of conveyance
29 driver
30 coding station
31 checking station
32 ejection station
33 turning station
34 baffle plate
35 motor
36 swivel arm
37 backing material
38 reel
39 deflection roller
40 printing station
41 slide bar
42 pneumatic cylinder
43 deflection rail
44 deflection roller
45 deflection roller
46 wind-up roller
47 support
48 axis
49 reel
50 packaging material
51 deflection roller
52 printing station
53 gluing station
54 cutting station
55 pneumatic cylinder
56 slide bar
57 conveyor belt
58 monitoring camera
59 slide bar
60 hinge joint
61 opening

The invention claimed is:

1. A method for producing bundle packages (10) for cigarettes, wherein a group of cigarette packs (12) is encased in an outer casing (13) to form the bundle package (10), and wherein the packs (12) respectively exhibit a code (19), and the group of packs (12) is encased in the outer casing (13) such that the code (19) of the packs (12) is not concealed by the outer casing (13) and that a means (20, 23) for concealing the code of the packs (12) and a code (21) for the bundle package (10) are then arranged on the bundle package (10), comprising:

a) providing a device comprising:

i) a conveyor line formed by a conveying means (27) and a coding station (30), wherein the coding station (30) is arranged along the conveyor line formed by a conveying means (27) for the bundle packages (10), the coding station (30) being for affixing the means (20, 23) for concealing the code (19) of the packs (12) and/or for affixing the code (21) to the bundle package (10) in a region of the code (19) of the packs (12), wherein the conveying means (27) is cyclically driven to allow the application of the concealing means (20, 23) and/or code means (21) to the bundle package (10) during a stationary phase of the conveying means (27); and ii) conveyor belts (24) upstream and downstream of the conveying means (27), the conveyor belts (24) being for transporting the bundle package (10) with its longitudinal extent pointing in the direction of conveyance, the conveyor belts being aligned parallel to the conveying means (27) and being arranged in an imaginary straight line, the conveying means (27) being positioned laterally offset to the conveyor line of the conveyor belts (24);

b) feeding the bundle package (10) to a coding station (30) for applying the code (21) for the bundle package (10) to the outer casing (13) and/or for affixing the means (20, 23) for concealing the code (19) of the packs (12), wherein the bundle package (10), at least in a region of the coding station (30), is transported by a cyclically driven conveying means (27); and c) briefly pausing the conveying means, wherein the code (21) and/or the concealing means (20, 23) are affixed in the coding station (30) during the brief pause of the conveying means (27).

2. The method as claimed in claim 1, further comprising subsequently feeding the coded bundle package (10) to a checking station (31) for checking the code (21) and/or the concealment (20, 23) of the code (19) of the packs (12), and separating out defective bundle packages (10) in a region of an ejection station (32) arranged after the checking station (31).

3. The method as claimed in claim 1, further comprising transporting the bundle package (10), at least in the region of the coding station (30) and/or in the region of the checking station (31), with its longitudinal extent substantially transversely to the direction of transport (25) of the conveying means (27), and affixing the code (21) of the bundle package (10) in the region of the code (19) of the packs (12) by a coding station (30) arranged beside the conveying means (27) in a region of transversely directed end faces (15) of the bundle package (10).

4. The method as claimed in claim 1, further comprising first transporting the bundle package (10) with its longitudinal extent substantially parallel to the direction of transport (25) of the conveying means (27) and, prior to reaching the coding station (30), then turning the bundle package (10) in a turning station (26) through about 90°, so that the bundle package (10) is transported with its longitudinal extent substantially transversely to the direction of transport (25) of the conveying means (27), and then turning the bundle package (10), after the coding station (30) and/or the checking station (31), in a further turning station (33) once more through about 90°, so that the bundle package (10) is transported with its longitudinal extent substantially again parallel to the direction of transport (25) of the conveying means (27).

5. The method as claimed in claim 1, further comprising, in the coding station (30), overprinting the code (19) of the packs (12) by a print (23) on the outer casing (13) and imprinting the code (21) of the bundle package (21) to the outer casing (13).

6. The method as claimed in claim 1, further comprising providing a continuous material strip (50) at intervals with a code (21) for respectively a bundle package (10) and subsequently separating the continuous material strip (50) into pre-cut pieces (20) by cutting of the material strip (50) between the codes (21), and providing the pre-cut pieces (20) with glue and fastening the pre-cut pieces (20), in the coding station (30), to respectively an outer casing (13) of a bundle package (10).

7. The method as claimed in claim 1, wherein the coding station (30) is arranged in the path of conveyance between a device for producing the bundle packages (10) and a device for grouping and/or cartoning the coded bundle packages (10).

8. A device for producing bundle packages (10) for cigarettes, wherein a group of cigarette packs (12) respectively exhibits a code (19), and for the formation of the bundle package (10) are encased in an at least partially transparent outer casing (13), so that the code (19) of the packs (12) is visible or readable through the outer casing (13), and wherein on the outer casing (13) are arranged means (20, 23) for covering the code (19) of the packs (12) and a code (21) of the bundle package (10), comprising:

a conveyor line formed by a conveying means (27) and a coding station (30), wherein the coding station (30) is arranged along the conveyor line formed by a conveying means (27) for the bundle packages (10), the coding station (30) being for affixing the means (20, 23) for concealing the code (19) of the packs (12) and/or for affixing the code (21) to the bundle package (10) in a region of the code (19) of the packs (12), wherein the conveying means (27) is cyclically driven to allow the application of the concealing means (20, 23) and/or code means (21) to the bundle package (10) during a stationary phase of the conveying means (27); and conveyor belts (24) upstream and downstream of the conveying means (27), the conveyor belts (24) being for transporting the bundle package (10) with its longitudinal extent pointing in the direction of conveyance, the conveyor belts being aligned parallel to the conveying means (27) and being arranged in an imaginary straight line, the conveying means (27) being positioned laterally offset to the conveyor line of the conveyor belts (24).

9. The device as claimed in claim 8, further comprising a checking station (31) downstream of the coding station (30), in a region of the conveyor line, the checking station (31) being for checking the code (21) and/or the concealment of the code (19) of the packs (12).

10. The device as claimed in claim 9, further comprising an ejection station (32) downstream of the checking station (31), in the region of the conveyor line, the ejection station (32) being for separating out defective bundle packages (10) from the conveying means (27).

11. The device as claimed in claim 8, wherein the bundle package (10), at least in a region of the coding station (30) and/or in a region of the checking station (31), is arranged on the conveying means (27) with its longitudinal extent pointing substantially transversely to the direction of conveyance (25), with outwardly directed end faces (15) for application of the code (21) in the coding station (30) arranged beside the conveyor line (27).

12. The device as claimed in claim 8, further comprising conveyor belts (24) upstream and downstream of the conveying means (27), the conveyor belts (24) being for transporting the bundle package (10) with its longitudinal extent pointing in the direction of conveyance, the conveyor belts being aligned parallel to the conveying means (27) and being arranged in an imaginary straight line, the conveying means (27) being positioned laterally offset to the conveyor line of the conveyor belts (24).

13. The device as claimed in claim 9, wherein pre-cut pieces (20) for concealing the code (19) of the packs (12) are fed from a reel (38) to the coding station (30), wherein on the reel (38) is wound a continuous material strip (37) as the backing material carrying, as the pre-cut pieces (20), labels arranged one behind the other at a distance apart, wherein the material strip is transportable in a plane running parallel to the end face (15) of the bundle packages, wherein the labels are printed in a printing station (40) while being fed from the reel (38) to the coding station (30), wherein the labels are detachable from the backing strip (37) by diversion of the material strip, wherein in the region of the diversion is arranged a slide bar (41) for receiving a label detached from the backing strip (37), and wherein the slide bar (41) is movable in a substantially horizontal plane toward a facing end face (15) of the bundle package (10) in order to affix the label to the outer casing (13) of the bundle package (10).

14. The device as claimed in claim 9, further comprising a reel (49) assigned to the coding station (30), the reel (49) bearing a continuous material strip of packaging material (50) for the formation of pre-cut pieces (20) for concealing the code (19) of the packs (12), wherein the material strip is drawn off from the reel (49) and is fed to a printing station (52) for the application of a code (19) and/or of an additional print (22) on the continuous material strip, wherein the printed material strip is fed to a gluing station (53) for applying a coating of glue to the material strip, wherein the glued material strip is fed to a cutting station (54) for separating pre-cut pieces (20) from the material strip, and wherein the separated pre-cut pieces (20) are movable by means of a slide bar (56) onto an end face (15) of the bundle package (10) for the application of the printed, glue-coated and separated pre-cut piece (20) to the outer casing (13) of the bundle package (10).

15. The device as claimed in claim 8, further comprising two coding stations (30) arranged consecutively along the conveyor line, wherein always just one coding station (30) is in operation for the uninterrupted operation of the coding station (30) during the supply of new material to one of the two coding stations (30) or during a change of material.

16. A method for producing bundle packages (10) for cigarettes, wherein a group of cigarette packs (12) is encased in an outer casing (13) to form the bundle package (10), and wherein the packs (12) respectively exhibit a code (19), and the group of packs (12) is encased in the outer casing (13) such that the code (19) of the packs (12) is not concealed by the outer casing (13) and that a means (20, 23) for concealing the code of the packs (12) and a code (21) for the bundle package (10) are then arranged on the bundle package (10), comprising:

feeding the bundle package (10) to a coding station (30) for applying the code (21) for the bundle package (10) to the outer casing (13) and/or for affixing the means (20, 23) for concealing the code (19) of the packs (12), wherein the bundle package (10), at least in a region of the coding station (30), is transported by a cyclically driven conveying means (27);

briefly pausing the conveying means, wherein the code (21) and/or the concealing means (20, 23) are affixed in the coding station (30) during the brief pause of the conveying means (27);

checking the code (21) and/or the concealment of the code (19) of the packs (12) in a checking station (31) downstream of the coding station (30), in a region of the conveyor line; and transporting the bundle package (10) with its longitudinal extent pointing in the direction of conveyance using conveyor belts (24) upstream and downstream of the conveying means (27), the conveyor belts being aligned parallel to the conveying means (27) and being arranged in an imaginary straight line, the conveying means (27) being positioned laterally offset to the conveyor line of the conveyor belts (24).

17. A method for producing bundle packages (10) for cigarettes, wherein a group of cigarette packs (12) is encased in an outer casing (13) to form the bundle package (10), and wherein the packs (12) respectively exhibit a code (19), and the group of packs (12) is encased in the outer casing (13) such that the code (19) of the packs (12) is not concealed by the outer casing (13) and that a means (20, 23) for concealing the code of the packs (12) and a code (21) for the bundle package (10) are then arranged on the bundle package (10), comprising:

feeding the bundle package (10) to a coding station (30) for applying the code (21) for the bundle package (10) to the outer casing (13) and/or for affixing the means (20, 23) for concealing the code (19) of the packs (12), wherein the bundle package (10), at least in a region of the coding station (30), is transported by a cyclically driven conveying means (27);

briefly pausing the conveying means, wherein the code (21) and/or the concealing means (20, 23) are affixed in the coding station (30) during the brief pause of the conveying means (27);

checking the code (21) and/or the concealment of the code (19) of the packs (12) in a checking station (31) downstream of the coding station (30), in a region of the conveyor line; and feeding pre-cut pieces (20) for concealing the code (19) of the packs (12) from a reel (38) to the coding station (30), winding a continuous material strip (37) on the reel (38) as the backing material carrying, as the pre-cut pieces (20), labels arranged one behind the other at a distance apart, wherein the material strip is transportable in a plane running parallel to the end face (15) of the bundle packages, printing the labels in a printing station (40) while being fed from the reel (38) to the coding station (30), wherein the labels are detachable from the backing strip (37) by diversion of the material strip, and arranging a slide bar (41) for receiving a label detached from the backing strip (37) in a region of the diversion, wherein the slide bar (41) is movable in a substantially horizontal plane toward a facing end face (15) of the bundle package (10) in order to affix the label to the outer casing (13) of the bundle package (10).

18. A method for producing bundle packages (10) for cigarettes, wherein a group of cigarette packs (12) is encased in an outer casing (13) to form the bundle package (10), and wherein the packs (12) respectively exhibit a code (19), and the group of packs (12) is encased in the outer casing (13) such that the code (19) of the packs (12) is not concealed by the outer casing (13) and that a means (20, 23) for concealing the code of the packs (12) and a code (21) for the bundle package (10) are then arranged on the bundle package (10), comprising:

feeding the bundle package (10) to a coding station (30) for applying the code (21) for the bundle package (10) to the outer casing (13) and/or for affixing the means (20, 23) for concealing the code (19) of the packs (12), wherein the bundle package (10), at least in a region of the coding station (30), is transported by a cyclically driven conveying means (27);

briefly pausing the conveying means, wherein the code (21) and/or the concealing means (20, 23) are affixed in the coding station (30) during the brief pause of the conveying means (27);

checking the code (21) and/or the concealment of the code (19) of the packs (12) in a checking station (31) downstream of the coding station (30), in a region of the conveyor line;

assigning a reel (49) to the coding station (30), the reel (49) bearing a continuous material strip of packaging material (50) for the formation of pre-cut pieces (20) for concealing the code (19) of the packs (12);

drawing the material strip off from the reel (49) and feeding the material strip to a printing station (52) for the application of a code (19) and/or of an additional print (22) on the continuous material strip;

feeding the printed material strip to a gluing station (53) for applying a coating of glue to the material strip; and feeding the glued material strip to a cutting station (54) for separating pre-cut pieces (20) from the material strip, wherein the separated pre-cut pieces (20) are movable by means of a slide bar (56) onto an end face (15) of the bundle package (10) for the application of the printed, glue-coated and separated pre-cut piece (20) to the outer casing (13) of the bundle package (10).

19. A device for producing bundle packages (10) for cigarettes, wherein a group of cigarette packs (12) respectively exhibits a code (19), and for the formation of the bundle package (10) are encased in an at least partially transparent outer casing (13), so that the code (19) of the packs (12) is visible or readable through the outer casing (13), and wherein on the outer casing (13) are arranged means (20, 23) for covering the code (19) of the packs (12) and a code (21) of the bundle package (10), comprising:

a conveyor line formed by a conveying means (27) and a coding station (30), wherein the coding station (30) is arranged along the conveyor line formed by a conveying means (27) for the bundle packages (10), the coding station (30) being for affixing the means (20, 23) for concealing the code (19) of the packs (12) and/or for affixing the code (21) to the bundle package (10) in a region of the code (19) of the packs (12), wherein the conveying means (27) is cyclically driven to allow the application of the concealing means (20, 23) and/or code means (21) to the bundle package (10) during a stationary phase of the conveying means (27);

a checking station (31) downstream of the coding station (30), in a region of the conveyor line, the checking station (31) being for checking the code (21) and/or the concealment of the code (19) of the packs (12); and conveyor belts (24) upstream and downstream of the conveying means (27), the conveyor belts (24) being for transporting the bundle package (10) with its longitudinal extent pointing in the direction of conveyance, the conveyor belts being aligned parallel to the conveying means (27) and being arranged in an imaginary straight line, the conveying means (27) being positioned laterally offset to the conveyor line of the conveyor belts (24).

20. A device for producing bundle packages (10) for cigarettes, wherein a group of cigarette packs (12) respectively exhibits a code (19), and for the formation of the bundle package (10) are encased in an at least partially transparent outer casing (13), so that the code (19) of the packs (12) is visible or readable through the outer casing (13), and wherein on the outer casing (13) are arranged means (20, 23) for covering the code (19) of the packs (12) and a code (21) of the bundle package (10), comprising:

a conveyor line formed by a conveying means (27) and a coding station (30), wherein the coding station (30) is arranged along the conveyor line formed by a conveying means (27) for the bundle packages (10), the coding station (30) being for affixing the means (20, 23) for concealing the code (19) of the packs (12) and/or for affixing the code (21) to the bundle package (10) in a region of the code (19) of the packs (12), wherein the conveying means (27) is cyclically driven to allow the application of the concealing means (20, 23) and/or code means (21) to the bundle package (10) during a stationary phase of the conveying means (27); and a checking station (31) downstream of the coding station (30), in a region of the conveyor line, the checking station (31) being for checking the code (21) and/or the concealment of the code (19) of the packs (12), wherein pre-cut pieces (20) for concealing the code (19) of the packs (12) are fed from a reel (38) to the coding station (30), wherein on the reel (38) is wound a continuous material strip (37) as the backing material carrying, as the pre-cut pieces (20), labels arranged one behind the other at a distance apart, wherein the material strip is transportable in a plane running parallel to the end face (15) of the bundle packages, wherein the labels are printed in a printing station (40) while being fed from the reel (38) to the coding station (30), wherein the labels are detachable from the backing strip (37) by diversion of the material strip, wherein in a region of the diversion is arranged a slide bar (41) for receiving a label detached from the backing strip (37), and wherein the slide bar (41) is movable in a substantially horizontal plane toward a facing end face (15) of the bundle package (10) in order to affix the label to the outer casing (13) of the bundle package (10).

21. A device for producing bundle packages (10) for cigarettes, wherein a group of cigarette packs (12) respectively exhibits a code (19), and for the formation of the bundle package (10) are encased in an at least partially transparent outer casing (13), so that the code (19) of the packs (12) is visible or readable through the outer casing (13), and wherein on the outer casing (13) are arranged means (20, 23) for covering the code (19) of the packs (12) and a code (21) of the bundle package (10), comprising:

a conveyor line formed by a conveying means (27) and a coding station (30), wherein the coding station (30) is arranged along the conveyor line formed by a conveying means (27) for the bundle packages (10), the coding station (30) being for affixing the means (20, 23) for concealing the code (19) of the packs (12) and/or for affixing the code (21) to the bundle package (10) in a region of the code (19) of the packs (12), wherein the conveying means (27) is cyclically driven to allow the application of the concealing means (20, 23) and/or code means (21) to the bundle package (10) during a stationary phase of the conveying means (27);

a checking station (31) downstream of the coding station (30), in a region of the conveyor line, the checking station (31) being for checking the code (21) and/or the concealment of the code (19) of the packs (12); and a reel (49) assigned to the coding station (30), the reel (49) bearing a continuous material strip of packaging material (50) for the formation of pre-cut pieces (20) for concealing the code (19) of the packs (12), wherein the material strip is drawn off from the reel (49) and is fed to a printing station (52) for the application of a code (19) and/or of an additional print (22) on the continuous material strip, wherein the printed material strip is fed to a gluing station (53) for applying a coating of glue to the material strip, wherein the glued material strip is fed to a cutting station (54) for separating pre-cut pieces (20) from the material strip, and wherein the separated pre-cut pieces (20) are movable by means of a slide bar (56) onto an end face (15) of the bundle package (10) for the application of the printed, glue-coated and separated pre-cut piece (20) to the outer casing (13) of the bundle package (10).

* * * * *